US011134348B2

(12) United States Patent
Mosgaard et al.

(10) Patent No.: US 11,134,348 B2
(45) Date of Patent: Sep. 28, 2021

(54) METHOD OF OPERATING A HEARING AID SYSTEM AND A HEARING AID SYSTEM

(71) Applicant: WIDEX A/S, Lynge (DK)

(72) Inventors: Lars Dalskov Mosgaard, Copenhagen (DK); Thomas Bo Elmedyb, Herlev (DK); Michael Johannes Pihl, Copenhagen (DK); Pejman Mowlaee, Valby (DK); David Pelegrin-Garcia, Lyngby (DK)

(73) Assignee: WIDEX A/S, Lynge (DK)

( * ) Notice: Subject to any disclaimer, the term of this patent is extended or adjusted under 35 U.S.C. 154(b) by 0 days.

(21) Appl. No.: 16/760,246

(22) PCT Filed: Oct. 30, 2018

(86) PCT No.: PCT/EP2018/079681
§ 371 (c)(1),
(2) Date: Apr. 29, 2020

(87) PCT Pub. No.: WO2019/086439
PCT Pub. Date: May 9, 2019

(65) Prior Publication Data

US 2020/0322735 A1 Oct. 8, 2020

(30) Foreign Application Priority Data

Oct. 31, 2017 (DK) ..... PA201700611
Oct. 31, 2017 (DK) ..... PA201700612
(Continued)

(51) Int. Cl.
*H04R 25/00* (2006.01)

(52) U.S. Cl.
CPC ..... *H04R 25/407* (2013.01); *H04R 25/405* (2013.01); *H04R 25/505* (2013.01);
(Continued)

(58) Field of Classification Search
CPC .. H04R 25/407; H04R 25/405; H04R 25/505; H04R 25/70; H04R 25/552;
(Continued)

(56) References Cited

U.S. PATENT DOCUMENTS 8,947,978 B2 * 2/2015 Mejia ..... G01S 3/808 367/124
9,591,411 B2 * 3/2017 Jensen ..... H04R 25/30
(Continued)

FOREIGN PATENT DOCUMENTS

WO 2012/076045 A1 6/2012
WO 2016/100460 A1 6/2016

OTHER PUBLICATIONS

Sam Karimian-Azari, et al., :"Robust DOA Estimation of Harmonic Signals Using Constrained Filters on Phase Estimates", Proceedings of the 22nd European Signal Processing Conference (EUSIPCO), Sep. 1, 2014, pp. 1930-1934.
(Continued)

*Primary Examiner* — Brian Ensey
(74) *Attorney, Agent, or Firm* — Sughrue Mion, PLLC

(57) ABSTRACT

A method of operating a hearing aid system in order to provide improved performance for a multitude of hearing aid system processing stages and a hearing aid system (400) for carrying out the method.

13 Claims, 4 Drawing Sheets

(30) Foreign Application Priority Data

Aug. 15, 2018 (DK) ..... PA201800462
Aug. 15, 2018 (DK) ..... PA201800465

(52) U.S. Cl.
CPC ..... *H04R 25/552* (2013.01); *H04R 25/554* (2013.01); *H04R 25/70* (2013.01); *H04R 2225/41* (2013.01); *H04R 2225/43* (2013.01); *H04R 2225/55* (2013.01); *H04R 2460/01* (2013.01)

(58) Field of Classification Search
CPC ..... H04R 25/554; H04R 2225/55; H04R 2225/41; H04R 2460/01; H04R 2225/43; H04S 1/005
See application file for complete search history.

(56) References Cited

U.S. PATENT DOCUMENTS 10,321,241 B2 * 6/2019 Lunner ..... G01S 3/801
10,951,995 B2 * 3/2021 Bramslow ..... H04R 25/356
2012/0127832 A1 5/2012 Mejia
2012/0179458 A1 7/2012 Oh et al.
2013/0208896 A1 8/2013 Chatlani et al.
2015/0163602 A1 6/2015 Pedersen et al.
2015/0289064 A1 10/2015 Jensen et al.
2015/0312663 A1 10/2015 Traa et al.

OTHER PUBLICATIONS

Johannes Nix et al., "Sound source localization in real sound fields based on empirical statistics of interaural parameters", The Journal of the Acoustical Society of America, Jan. 2006, pp. 463-479, vol. 119 (1).
Danish Search and Examination Report for PA 201800465 dated Nov. 28, 2018.
International Search Report for PCT/EP2018/079681 dated Feb. 11, 2019 (PCT/ISA/210).
Written Opinion for PCT/EP2018/079681 dated Feb. 11, 2019 (PCT/ISA/237).
Cabot, "An Introduction to Circular Statistics and its Application to Sound Localization Experiments", 58th Convention Audio Engineering Society, Nov. 1977, http://www.aes.org/tmpFiles/elib/20190109/3062.pdf (19 pages total).
Markovic et al., "Active Speaker Localization with Circular Likelihoods and Bootstrap Filtering", IEEE/RSJ International Conference on Intelligent Robots and Sytems (IROS), Nov. 3-7, 2013, pp. 2914-2920 (7 pages total).

* cited by examiner

METHOD OF OPERATING A HEARING AID SYSTEM AND A HEARING AID SYSTEM

CROSS REFERENCE TO RELATED APPLICATIONS

This application is a National Stage of International Application No. PCT/EP2018/079681 filed Oct. 30, 2018, claiming priorities based on Danish Patent Application Nos. PA201700611 and PA201700612 filed Oct. 31, 2017 and Danish Patent Application Nos. PA201800462 and PA201800465 filed Aug. 15, 2018.

The present invention relates to a method of operating a hearing aid system. The present invention also relates to a hearing aid system adapted to carry out said method.

BACKGROUND OF THE INVENTION

Generally a hearing aid system according to the invention is understood as meaning any device which provides an output signal that can be perceived as an acoustic signal by a user or contributes to providing such an output signal, and which has means which are customized to compensate for an individual hearing loss of the user or contribute to compensating for the hearing loss of the user. They are, in particular, hearing aids which can be worn on the body or by the ear, in particular on or in the ear, and which can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context a traditional hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore, the hearing aid system may comprise an external device, such as a smart phone having software applications adapted to interact with other devices of the hearing aid system. Thus within the present context the term "hearing aid system device" may denote a hearing aid or an external device.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids, a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Hearing loss of a hearing impaired person is quite often frequency-dependent. This means that the hearing loss of the person varies depending on the frequency. Therefore, when compensating for hearing losses, it can be advantageous to utilize frequency-dependent amplification. Hearing aids therefore often provide to split an input sound signal received by an input transducer of the hearing aid, into various frequency intervals, also called frequency bands, which are independently processed. In this way, it is possible to adjust the input sound signal of each frequency band individually to account for the hearing loss in respective frequency bands.

A number of hearing aid features such as beamforming, noise reduction schemes and compressor settings are not universally beneficial and preferred by all hearing aid users. Therefore detailed knowledge about a present acoustic situation is required to obtain maximum benefit for the individual user. Especially, knowledge about the number of talkers (or other target sources) present and their position relative to the hearing aid user and knowledge about the diffuse noise are relevant. Having access to this knowledge in real-time can be used to classify the general sound environment but can also be used to a multitude of other features and processing stages of a hearing aid system.

It is therefore a feature of the present invention to provide an improved method of operating a hearing aid system.

It is another feature of the present invention to provide a hearing aid system adapted to provide such a method of operating a hearing aid system.

SUMMARY OF THE INVENTION

The invention, in a first aspect, provides a method of operating a hearing aid system comprising the steps of:

- providing a plurality of input signal sets, each consisting of two input signals, wherein the input signals represent the output from a microphone;
- transforming the input signals from a time domain representation and into a time-frequency domain representation;
- estimating an inter-microphone phase difference between the input signals for each of said plurality of input signal sets using the time-frequency domain representation of the input signals;

determining an unbiased mean phase and a mapped mean resultant length, from each of said estimated inter-microphone phase differences;

estimating a time difference of arrival, for each of said input signal sets, using a plurality of unbiased mean phases weighted by a corresponding plurality of reliability measures, wherein each of the reliability measures are derived at least partly from a corresponding mapped mean resultant length;

deriving an estimate of a local direction of arrival and a corresponding local reliability measure for each of the estimated time difference of arrivals, wherein the local reliability measures are at least partly derived from the corresponding mapped mean resultant lengths;

providing an estimate of a common direction of arrival by combining the estimated local directions of arrival and the corresponding local reliability measures;

using the estimate of the common direction of arrival as input to at least one hearing aid system processing stage.

This provides an improved method of operating a hearing aid system.

The invention, in a second aspect, provides a hearing aid system comprising a first and a second hearing aid and a binaural wireless link between the two hearing aids, wherein each of the hearing aids comprises a set of microphones, a filter bank, a digital signal processor and an electrical-acoustical output transducer;

wherein the binaural wireless link is adapted to provide, for each of the hearing aids, transmission of at least one ipse-lateral input signal, from an ipse-lateral microphone, to the contra-lateral hearing aid whereby at least one binaural microphone set is provided; wherein the filter bank is adapted to:

transform the input signals from the provided microphone sets from a time domain representation and into a time-frequency domain representation;

wherein the digital signal processor is configured to apply a frequency dependent gain that is adapted to at least one of suppressing noise and alleviating a hearing deficit of an individual wearing the hearing aid system;

wherein the digital signal processor is adapted to:

estimating inter-microphone phase differences between the input signals for each of the provided microphone sets using the time-frequency domain representation of the input signals;

determining an unbiased mean phase and a mapped mean resultant length, from each of said estimated inter-microphone phase differences;

estimating a time difference of arrival, for each of said input signal sets, using a plurality of unbiased mean phases weighted by a corresponding plurality of reliability measures, wherein each of the reliability measures are derived at least partly from a corresponding mapped mean resultant length;

deriving an estimate of a local direction of arrival and a corresponding local reliability measure for each of the estimated time difference of arrivals, wherein the local reliability measures are at least partly derived from the corresponding mapped mean resultant lengths;

providing an estimate of a common direction of arrival by combining the estimated local directions of arrival and the corresponding local reliability measures; and using the estimate of the common direction of arrival as input to at least one hearing aid system processing stage.

This provides a hearing aid system with improved means for operating a hearing aid system.

The invention, in a third aspect, provides a non-transitory computer readable medium carrying instructions which, when executed by a computer, cause the following method to be performed:

providing a plurality of input signal sets, each consisting of two input signals, wherein the input signals represent the output from a microphone;

transforming the input signals from a time domain representation and into a time-frequency domain representation;

estimating an inter-microphone phase difference between the input signals for each of said plurality of input signal sets using the time-frequency domain representation of the input signals;

determining an unbiased mean phase and a mapped mean resultant length, from each of said estimated inter-microphone phase differences;

estimating a time difference of arrival, for each of said input signal sets, using a plurality of unbiased mean phases weighted by a corresponding plurality of reliability measures, wherein each of the reliability measures are derived at least partly from a corresponding mapped mean resultant length;

deriving an estimate of a local direction of arrival and a corresponding local reliability measure for each of the estimated time difference of arrivals, wherein the local reliability measures are at least partly derived from the corresponding mapped mean resultant lengths;

providing an estimate of a common direction of arrival by combining the estimated local directions of arrival and the corresponding local reliability measures;

using the estimate of the common direction of arrival as input to at least one hearing aid system processing stage.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

In the present context the term signal processing is to be understood as any type of hearing aid system related signal processing that includes at least: beam forming, noise reduction, speech enhancement and hearing compensation.

In the present context the terms beam former and directional system may be used interchangeably.

Figure 1:
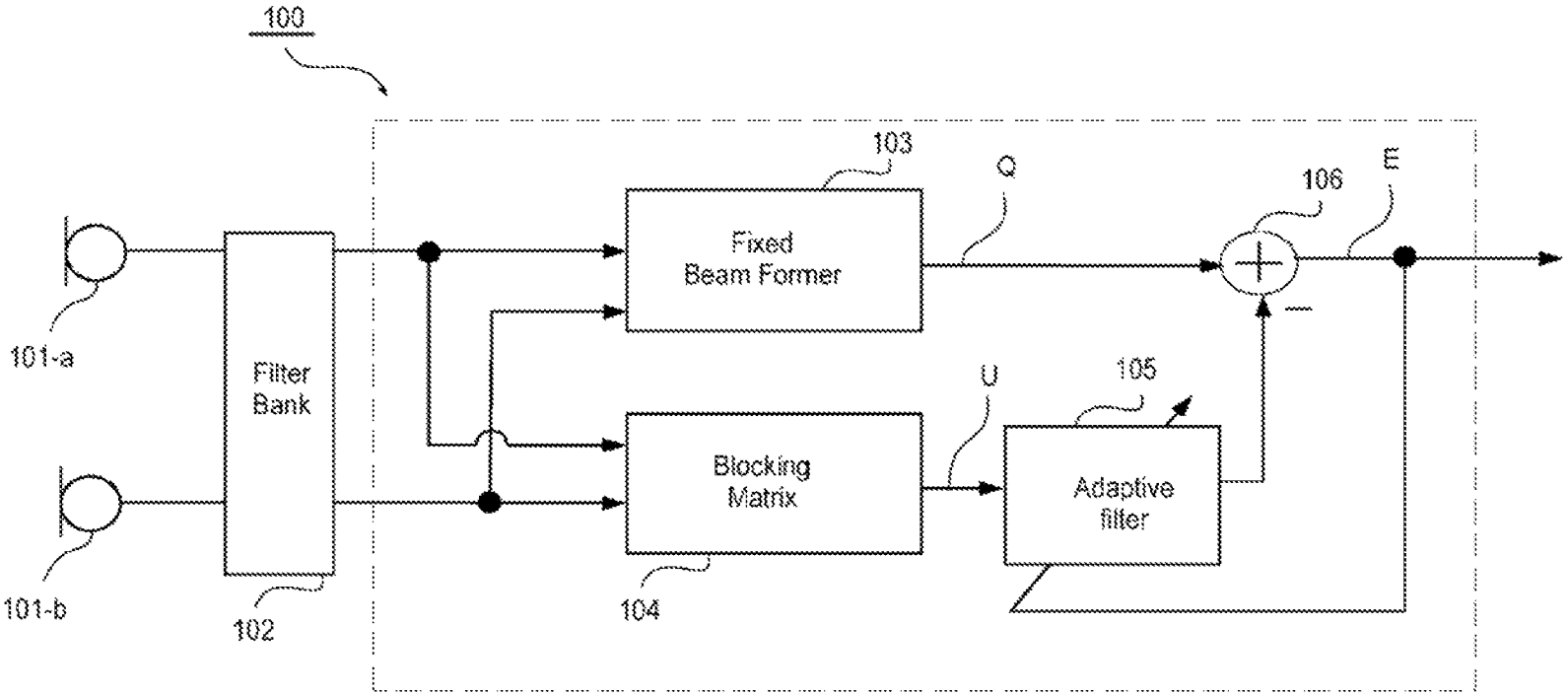
FIG. 1 illustrates highly schematically a directional system.

Reference is first made to FIG. 1, which illustrates highly schematically a directional system 100 suitable for implementation in a hearing aid system according to an embodiment of the invention.

The directional system 100 takes as input, the digital output signals, at least, derived from the two acoustical-electrical input transducers 101*a-b*.

According to the embodiment of FIG. 1, the acoustical-electrical input transducers 101*a-b*, which in the following may also be denoted microphones, provide analog output signals that are converted into digital output signals by analog-digital converters (ADC) and subsequently provided to a filter bank 102 adapted to transform the signals into the time-frequency domain. One specific advantage of transforming the input signals into the time-frequency domain is that both the amplitude and phase of the signals become directly available in the provided individual time-frequency bins. According to an embodiment a Fast Fourier Transform (FFT) may be used for the transformation and in variations other time-frequency domain transformations can be used such as a Discrete Fourier Transform (DTF), a polyphase filterbank or a Discrete Cosine Transformation.

However, for reasons of clarity the ADCs are not illustrated in FIG. 1. Furthermore, in the following, the output signals from the filter bank 102 will primarily be denoted input signals because these signals represent the primary input signals to the directional system 100. Additionally, the term digital input signal may be used interchangeably with the term input signal. In a similar manner all other signals referred to in the present disclosure may or may not be specifically denoted as digital signals. Finally, at least the terms input signal, digital input signal, frequency band input signal, sub-band signal and frequency band signal may be used interchangeably in the following and unless otherwise noted the input signals can generally be assumed to be frequency band signals independent on whether the filter bank 102 provide frequency band signals in the time domain or in the time-frequency domain. Furthermore, it is generally assumed, here and in the following, that the microphones 101*a-b* are omni-directional unless otherwise mentioned.

In a variation the input signals are not transformed into the time-frequency domain. Instead the input signals are first transformed into a number of frequency band signals by a time-domain filter bank comprising a multitude of time-domain bandpass filters, such as Finite Impulse Response bandpass filters and subsequently the frequency band signals are compared using correlation analysis wherefrom the phase is derived.

Both the digital input signals are branched, whereby the input signals, in a first branch, is provided to a Fixed Beam Former (FBF) unit 103, and, in a second branch, is provided to a blocking matrix 104.

In the second branch the digital input signals are provided to the blocking matrix 104 wherein an assumed or estimated target signal is removed and whereby an estimated noise signal that in the following will be denoted U may be determined from the equation:

$$U=\overline{B}^H\overline{X} \qquad \text{(equation 1)}$$

Wherein the vector $\overline{X}^T=[M_1,M_2]$ holds the two (microphone) input signals and wherein the vector B represents the blocking matrix 104. The blocking matrix may be given by:

$$\overline{B}=\begin{bmatrix}-D\\1\end{bmatrix} \qquad \text{(eq. 2)}$$

Wherein D is the Inter-Microphone Transfer Function (which in the following may be abbreviated IMTF) that represents the transfer function between the two microphones with respect to a specific source. In the following the IMTF may interchangeably also be denoted the steering vector.

In the first branch, which in the following also may be denoted the omni branch, the digital input signals are provided to the FBF unit 103 that provides an omni signal Q given by the equation:

$$Q=\overline{W_0}^H\overline{X} \qquad \text{(eq. 3)}$$

Wherein the vector $\overline{W_0}$ represents the FBF unit 103 that may be given by:

$$\overline{W_0}=(1+DD^*)^{-1}\begin{bmatrix}1\\D^*\end{bmatrix} \qquad \text{(eq. 4)}$$

It can be shown that the presented choice of the Blocking Matrix 104 and the FBF unit 103 is optimal using a least mean square (LMS) approach.

The estimated noise signal U provided by the blocking matrix 104 is filtered by the adaptive filter 105 and the resulting filtered estimated noise signal is subtracted, using the subtraction unit 106, from the omni-signal Q provided in the first branch in order to remove the noise, and the resulting beam formed signal E is provided to further processing in the hearing aid system, wherein the further processing may comprise application of a frequency dependent gain in order to alleviate a hearing loss of a specific hearing aid system user and/or processing directed at reducing noise or improving speech intelligibility.

The resulting beam formed signal E may therefore be expressed using the equation:

$$E=\overline{W_0}^H\overline{X}-H\overline{B}^H\overline{X} \qquad \text{(eq. 5)}$$

Wherein H represents the adaptive filter 105, which in the following may also interchangeably be denoted the active noise cancellation filter.

The input signal vector $\overline{X}$ and the output signal E of the directional system 100 may be expressed as:

$$\overline{X}=\begin{bmatrix}X_t^{M_1}\\X_t^{M_2}\end{bmatrix}+\begin{bmatrix}X_n^{M_1}\\X_n^{M_2}\end{bmatrix}=X_t\begin{bmatrix}1\\D^*\end{bmatrix}+\begin{bmatrix}X_n^{M_1}\\X_n^{M_2}\end{bmatrix} \qquad \text{(eq. 6)}$$

and:

$$E=X_t+\frac{X_n^{M_1}+DX_n^{M_2}}{1+DD^*}-H\left(X_n^{M_2}-D^*X_n^{M_1}\right) \qquad \text{(eq. 7)}$$

Wherein the subscript n represents noise and subscript t represents the target signal.

It follows that the second branch perfectly cancels the target signal and consequently the target signal is, under ideal conditions, fully preserved in the output signal E of the directional system 100.

It can also be shown that the directional system 100, under ideal conditions, in the LMS sense will cancel all the noise without compromising the target signal. However, it is, under realistic conditions, practically impossible to control the blocking matrix such that the target signal is completely cancelled. This results in the target signal bleeding into the estimated noise signal U, which means that the adaptive filter 105 will start to cancel the target signal. Furthermore, in a realistic environment, the blocking matrix 104 needs to also take into account not only the direct sound from a target source but also the early reflections from the target source, in order to ensure optimum performance because these early reflections may contribute to speech intelligibility. Thus if the early reflections are not suppressed by the blocking matrix 104, then these early reflections will be considered noise and the adaptive filter 105 will attempt to cancel them.

It has therefore been suggested in the art to accept that it is not possible to remove the target signal completely and a constraint is therefore put on the adaptive filter 105. However, this type of strategy for making the directional system robust against cancelling of the target signal comes at the price of a reduction in performance.

Thus, in addition to improving the accuracy of the blocking matrix with respect to suppressing a target signal, it is desirable to be able to estimate the accuracy of the blocking matrix 104 and also the nature of the spatial sound in order to be able to make a conscious trade-off between beam forming performance and robustness.

According to the present invention this may be achieved by considering the IMTF for a given target sound source. For the estimation of the IMTF the properties of periodic variables need to be considered. In the following, periodic variables will due to mathematically convenience be described as complex numbers. An estimate of the IMTF for a given target sound source may therefore be given as a complex number that in polar representation has an amplitude A and a phase θ. The average of a multitude of IMTF estimates may be given by:

$$\langle Ae^{-i\theta}\rangle = \frac{1}{n}\sum_{i=1}^{n} A_i e^{-i\theta_i} = R_A e^{-i\hat{\theta}_A} \quad \text{(eq. 8)}$$

Wherein ⟨ ⟩ is the average operator, n represents the number of IMTF estimates used for the averaging, $R_A$ is an averaged amplitude that depends on the phase and that may assume values in the interval $[0,\langle A\rangle]$, and $\hat{\theta}_A$ is the weighted mean phase. It can be seen that the amplitude A of each individual sample weight each corresponding phase $\theta_i$ in the averaging. Therefore both the averaged amplitude $R_A$ and the weighted mean phase $\hat{\theta}_A$ are biased (i.e. dependent on the other).

It is noted that the present invention is independent of the specific choice of statistical operator used to determine an average, and consequently within the present context the terms expectation operator, average, sample mean, expectation or mean may be used to represent the result of statistical functions or operators selected from a group comprising the Boxcar function. In the following these terms may therefore be used interchangeably.

The amplitude weighting providing the weighted mean phase $\hat{\theta}_A$ will generally result in the weighted mean phase $\hat{\theta}_A$ being different from the unbiased mean phase $\hat{\theta}$ that is defined by:

$$\langle e^{-i\theta}\rangle = \frac{1}{n}\sum_{i=1}^{n} e^{-i\theta_i} = \mathrm{R}e^{-i\hat{\theta}} \quad \text{(eq. 9)}$$

As in equation (8) ⟨ ⟩ is the average operator and n represents the number of inter-microphone phase difference samples used for the averaging. For convenience reasons the inter-microphone phase difference samples may in the following simply be denoted inter-microphone phase differences. It follows that the unbiased mean phase $\hat{\theta}$ can be estimated by averaging a multitude of inter-microphone phase difference samples. R is denoted the resultant length and the resultant length R provides information on how closely the individual phase estimates $\theta_i$ are grouped together and the circular variance V and the resultant length R are related by:

$$V=1-R \quad \text{(eq. 10)}$$

The inventors have found that the information regarding the amplitude relation, which is lost in the determination of the unbiased mean phase $\hat{\theta}$, the resultant length R and the circular variance V turns out to be advantageous because more direct access to the underlying phase probability distribution is provided.

Considering again the directional system 100 described above the optimum steering vector D* may be given by:

$$\frac{d(\mathbb{E}((M_2(f)-D(f)M_1(f))(M_2^*(f)-D^*(f)M_1^*(f))))}{dD^*} = 0 \Rightarrow D(f) = \frac{\mathbb{E}(M_2(f)M_1^*(f))}{\mathbb{E}(|M_1(f)|^2)}; \quad \text{(eq. 11)}$$

Wherein $\mathbb{E}$ is the expectation operator.

It is noted that the optimal estimate of the IMTF in the LMS sense is closely related to the coherence C(f) that may be given as:

$$C(f) = \frac{|D(f)|^2}{\frac{\mathbb{E}(|M_2(f)|^2)}{\mathbb{E}(|M_1(f)|^2)}} = \frac{|\mathbb{E}(M_2(f)M_1^*(f))|^2}{\mathbb{E}(|M_2(f)|^2)\mathbb{E}(|M_1(f)|^2)} \quad \text{(eq. 12)}$$

It is noted that the derived expression for the optimal IMTF, using the least mean square approach, is subject to bias problems both in the estimation of the phase and amplitude relation because the averaged amplitude is phase dependent and the weighted mean phase is amplitude dependent, both of which is undesirable. This however is the strategy for estimating the IMTF commonly taken.

The present invention provides an alternative method of estimating the phase of the steering vector which is optimal in the LMS sense, when the normalized input signals are considered as opposed to the input signals considered alone. In the following this optimal steering vector based on normalized input signals will be denoted $D_N(f)$:

$$\frac{d\left(\mathbb{E}\left(\left(\frac{M_2(f)}{|M_2(f)|} - D_N(f)\frac{M_1(f)}{|M_1(f)|}\right)\left(\frac{M_2^*(f)}{|M_2(f)|} - D_N^*(f)\frac{M_1^*(f)}{|M_1(f)|}\right)\right)\right)}{dD_N^*} = 0 \Rightarrow D_N(f) = \mathbb{E}\left(\frac{M_2(f)M_1^*(f)}{|M_2(f)||M_1(f)|}\right) = \mathrm{R}e^{-i\hat{\theta}} \quad \text{(eq. 13)}$$

It follows that by using this LMS optimization according to an embodiment of the present invention, then access to the "correct" phase, in the form of the unbiased mean phase $\hat{\theta}$ and to the variance V (derivable directly from the resultant length R using equation 10), is obtained at the cost of losing the information concerning the amplitude part of the IMTF.

However, according to an embodiment the amplitude part is estimated simply by selecting at least one set of input signals that has contributed to providing a high value of the resultant length, wherefrom it may be assumed that the input signals are not primarily noise and that therefore the biased mean amplitude corresponding to said set of input signals is relatively accurate. Furthermore, the value of unbiased mean phase can be used to select between different target sources.

According to yet another, and less advantageous variation the biased mean amplitude is used to control the directional system without considering the corresponding resultant length.

According to another variation the amplitude part is determined by transforming the unbiased mean phase using a transformation selected from a group comprising the Hilbert transformation.

Thus having improved estimations of the amplitude and phase of the IMTF a directional system with improved performance is obtained. The method has been disclosed in connection with a Generalized Sidelobe Canceller (GSC) design, but may in variations also be applied to improve performance of other types of directional systems such as a multi-channel Wiener filter, a Minimum Mean Squared Error (MMSE) system and a Linearly Constrained Minimum Variance (LCMV) system. However, the method may also be applied for directional system that is not based on energy minimization.

Generally, it is worth appreciating that the determination of the amplitude and phase of the IMTF according to the present invention can be determined purely based on input signals and as such is highly flexible with respect to its use in various different directional systems.

It is noted that the approach of the present invention, despite being based on LMS optimization of normalized input signals, is not the same as the well known Normalized Least Mean Square (NLMS) algorithm, which is directed at improving the convergence properties.

For the IMTF estimation strategy to be robust in realistic dynamic sound environments it is generally preferred that the input signals (i.e. the sound environment) can be considered quasi stationary. The two main sources of dynamics are the temporal and spatial dynamics of the sound environment. For speech the duration of a short consonant may be as short as only 5 milliseconds, while long vowels may have a duration of up to 200 milliseconds depending on the specific sound. The spatial dynamics is a consequence of relative movement between the hearing aid user and surrounding sound sources. As a rule of thumb speech is considered quasi stationary for a duration in the range between say 20 and 40 milliseconds and this includes the impact from spatial dynamics.

For estimation accuracy, it is generally preferable that the duration of the involved time windows are as long as possible, but it is, on the other hand, detrimental if the duration is so long that it covers natural speech variations or spatial variations and therefore cannot be considered quasi-stationary.

According to an embodiment of the present invention a first time window is defined by the transformation of the digital input signals into the time-frequency domain and the longer the duration of the first time window the higher the frequency resolution in the time-frequency domain, which obviously is advantageous. Additionally, the present invention requires that the determination of an unbiased mean phase or the resultant length of the IMTF for a particular angular direction or the final estimate of an inter-microphone phase difference is based on a calculation of an expectation value and it has been found that the number of individual samples used for calculation of the expectation value preferably exceeds at least 5.

According to a specific embodiment the combined effect of the first time window and the calculation of the expectation value provides an effective time window that is shorter than 40 milliseconds or in the range between 5 and 200 milliseconds such that the sound environment in most cases can be considered quasi-stationary.

According to a variation improved accuracy of the unbiased mean phase or the resultant length may be provided by obtaining a multitude of successive samples of the unbiased mean phase and the resultant length, in the form of a complex number using the methods according to the present invention and subsequently adding these successive estimates (i.e. the complex numbers) and normalizing the result of the addition with the number of added estimates. This embodiment is particularly advantageous in that the resultant length effectively weights the samples that have a high probability of comprising a target source, while estimates with a high probability of mainly comprising noise will have a negligible impact on the final value of the unbiased mean phase of the IMTF or inter-microphone phase difference because the samples are characterized by having a low value of the resultant length. Using this method it therefore becomes possible to achieve pseudo time windows with a duration up to say several seconds or even longer and the improvements that follows therefrom, despite the fact that neither the temporal nor the spatial variations can be considered quasi-stationary.

In a variation at least one or at least not all of the successive complex numbers representing the unbiased mean phase and the resultant length are used for improving the estimation of the unbiased mean phase of the IMTF or inter-microphone phase difference, wherein the selection of the complex numbers to be used are based on an evaluation of the corresponding resultant length (i.e. the variance) such that only complex numbers representing a high resultant length are considered.

According to another variation the estimation of the unbiased mean phase of the IMTF or inter-microphone phase difference is additionally based on an evaluation of the value of the individual samples of the unbiased mean phase such that only samples representing the same target source are combined.

According to yet another variation speech detection may be used as input to determine a preferred unbiased mean phase for controlling a directional system, e.g. by giving preference to target sources positioned at least approximately in front of the hearing aid system user, when speech is detected. In this way it may be avoided that a directional system enhances the direct sound from a source that does not provide speech or is positioned more to the side than another speaker, whereby speakers are preferred above other sound sources and a speaker in front of the hearing aid system user is preferred above speakers positioned more to the side.

According to still another embodiment monitoring of the unbiased mean phase and the corresponding variance may be used for speech detection either alone or in combination with traditional speech detection methods, such as the methods disclosed in WO-A1-2012076045. The basic principle of this specific embodiment being that an unbiased mean phase estimate with a low variance is very likely to represent a sound environment with a single primary sound source. However, since a single primary sound source may be single speaker or something else such as a person playing music it will be advantageous to combine the basic principle of this specific embodiment with traditional speech detection methods based on e.g. the temporal or level variations or the spectral distribution.

According to an embodiment the angular direction of a target source, which may also be denoted the direction of arrival (DOA) is derived from the unbiased mean phase and used for various types of signal processing.

As one specific example, the resultant length can be used to determine how to weight information, such as a determined DOA of a target source, from each hearing aid of a binaural hearing aid system.

More generally the resultant length can be used to compare or weight information obtained from a multitude of microphone pairs, such as the multitude of microphone pairs that are available in e.g. a binaural hearing aid system comprising two hearing aids each having two microphones.

According to a specific embodiment the determination of a an angular direction of a target source is provided by combining a monaurally determined unbiased mean phase with a binaurally determined unbiased mean phase, whereby the symmetry ambiguity that results when translating an estimated phase to a target direction may be resolved.

Figure 2:
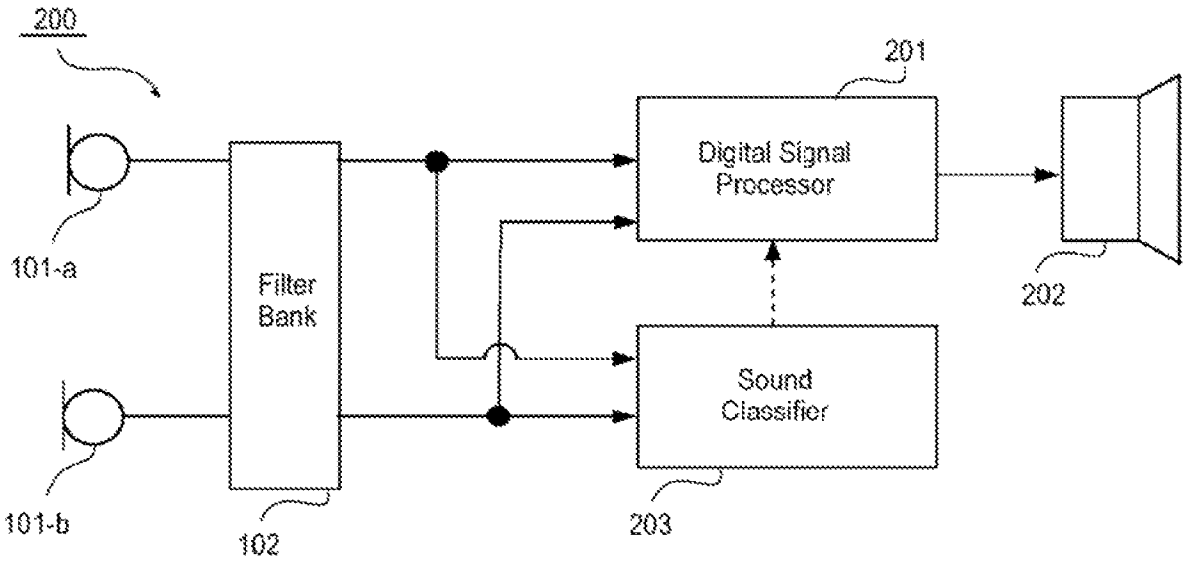
FIG. 2 illustrates highly schematically a hearing aid system according to an embodiment of the invention.

Reference is now made to FIG. 2, which illustrates highly schematically a hearing aid system 200 according to an embodiment of the invention. The components that have already been described with reference to FIG. 1 are given the same numbering as in FIG. 1.

The hearing aid system 200 comprises a first and a second acoustical-electrical input transducers 101*a-b*, a filter bank 102, a digital signal processor 201, an electrical-acoustical output transducer 202 and a sound classifier 203.

According to the embodiment of FIG. 2, the acoustical-electrical input transducers 101*a-b*, which in the following may also be denoted microphones, provide analog output signals that are converted into digital output signals by analog-digital converters (ADC) and subsequently provided to a filter bank 102 adapted to transform the signals into the time-frequency domain. One specific advantage of transforming the input signals into the time-frequency domain is that both the amplitude and phase of the signals become directly available in the provided individual time-frequency bins.

In the following the first and second input signals and the transformed first and second input signals may both be denoted input signals. The input signals 101-*a* and 101-*b* are branched and provided both to the digital signal processor 201 and to a sound classifier 203. The digital signal processor 201 may be adapted to provide various forms of signal processing including at least: beam forming, noise reduction, speech enhancement and hearing compensation.

The sound classifier 203 is configured to classify the current sound environment of the hearing aid system 200 and provide sound classification information to the digital signal processor such that the digital signal processor can operate dependent on the current sound environment.

Figure 3:
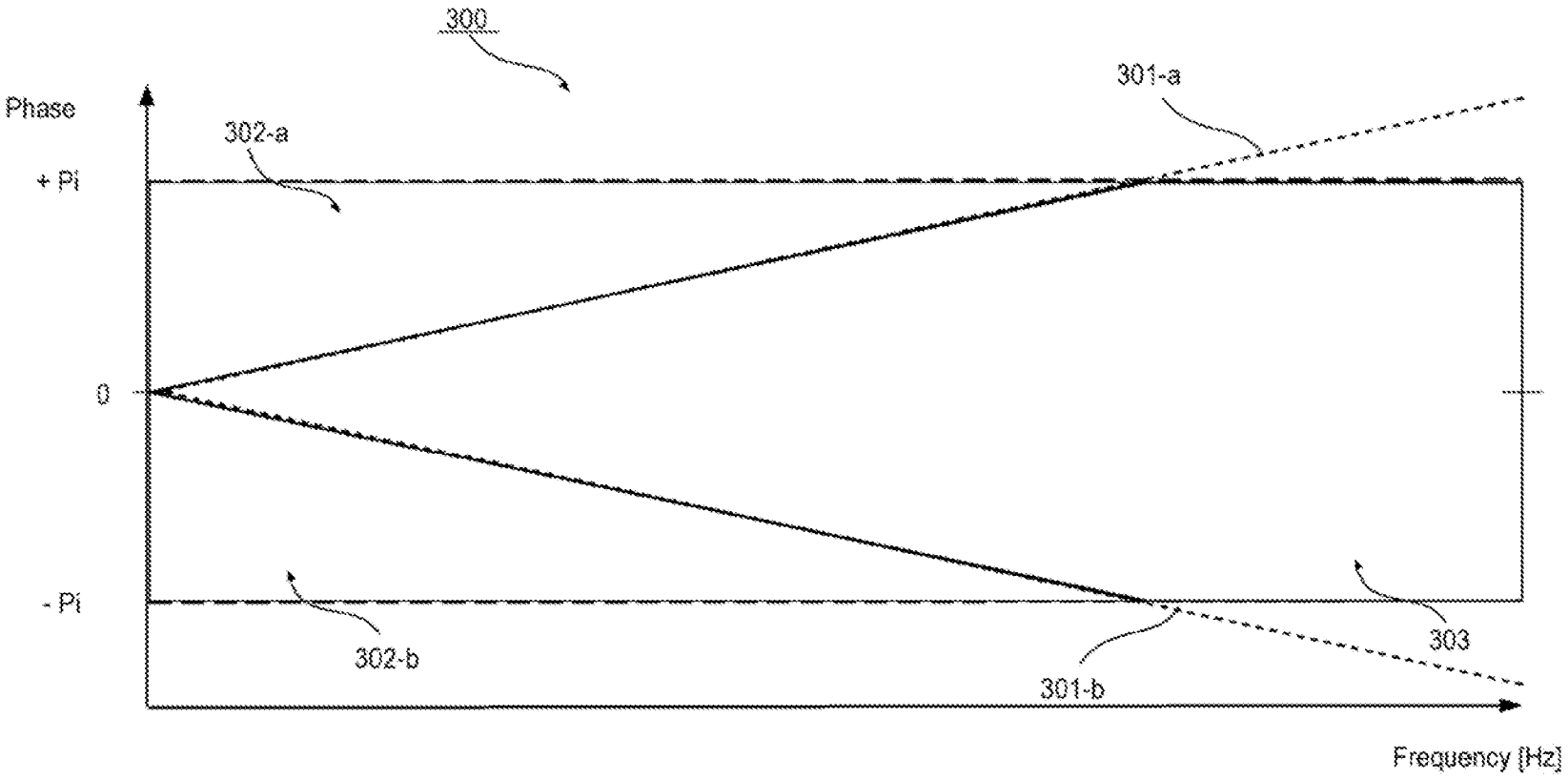
FIG. 3 illustrates highly schematically a phase versus frequency plot.

Reference is now made to FIG. 3, which illustrates highly schematically a map of values of the unbiased mean phase as a function of frequency in order to provide a phase versus frequency plot.

According to an embodiment of the present invention the phase versus frequency plot can be used to identify a direct sound if said mapping provides a straight line or at least a continuous curve in the phase versus frequency plot.

It is noted that the term "identifying" above and in the following is used interchangeably with the term "classifying".

Assuming free field a direct sound will provide a straight line in the plot, but in the real world conditions a non-straight curve will result, which will primarily be determined by the head related transfer function of the user wearing the hearing aid system and the mechanical design of the hearing aid system itself. Assuming free field the curve 301-A represents direct sound from a target positioned directly in front of the hearing aid system user assuming a contemporary standard hearing aid having two microphones positioned along the direction of the hearing aid system users nose. Correspondingly the curve 301-B represents direct sound from a target directly behind the hearing aid system user.

Generally, the angular direction of the direct sound from a given target source may be determined from the fact that the slope of the interpolated straight line representing the direct sound is given as:

$$\frac{\partial\theta}{\partial f} = \frac{2\pi a}{c} \quad \text{(eq. 14)}$$

Wherein d represent the distance between the microphone, c is the speed of sound.

According to an embodiment of the present invention the phase versus frequency plot can be used to identify a diffuse noise field if said mapping provides a uniform distribution, for a given frequency, within a coherent region, wherein the coherent region 303 is defined as the area in the phase versus frequency plot that is bounded by the at least continuous curves defining direct sounds coming directly from the front and the back direction respectively and the curves defining a constant phase of $+\pi$ and $-\pi$ respectively.

According to another embodiment of the present invention the phase versus frequency plot can be used to identify a random or incoherent noise field if said mapping provides a uniform distribution, for a given frequency, within a full phase region defined as the area in the phase versus frequency plot that is bounded by the two straight lines defining a constant phase of $+\pi$ and $-\pi$ respectively. Thus any data points outside the coherent region, i.e. inside the incoherent regions 302-*a* and 302-*b* will represent a random or incoherent noise field.

According to a variation a diffuse noise can be identified by in a first step transforming a value of the resultant length to reflect a transformation of the unbiased mean phase from inside the coherent region and onto the full phase region, and in a second step identifying a diffuse noise field if the transformed value of the resultant length, for at least one frequency range, is below a transformed resultant length diffuse noise trigger level. More specifically the step of transforming the values of the resultant length to reflect a transformation of the unbiased mean phase from inside the coherent region and onto the full phase region comprises the step of determining the values in accordance with the formula:

$$R_{transformed} = \left| E\left( \left( \frac{M_2(f)M_1^*(f)}{|M_1(f)||M_2(f)|} \right)^{c/2df} \right) \right| \quad \text{(eq. 15)}$$

wherein $M_1(f)$ and $M_2(f)$ represent the frequency dependent first and second input signals respectively.

According to other embodiments identification of a diffuse, random or incoherent noise field can be made if a value of the resultant length, for at least one frequency range, is below a resultant length noise trigger level.

Similarly identification of a direct sound can be made if a value of the resultant length, for at least one frequency range, is above a resultant length direct sound trigger level.

According to still further embodiments the resultant length may be used to: estimate the variance of a correspondingly determined unbiased mean phase from samples of inter-microphone phase differences, and evaluate the validity of a determined unbiased mean phase based on the estimated variance for the determined unbiased mean phase.

In variations the trigger levels are replaced by a continuous function, which maps the resultant length or the unwrapped resultant length to a signal-to-noise-ratio, wherein the noise may be diffuse or incoherent.

In another variation improved accuracy of the determined unbiased mean phase is achieved by at least one of averaging and fitting a multitude of determined unbiased mean phases across at least one of time and frequency by weighting the determined unbiased mean phases with the correspondingly determined resultant length.

In yet another variation the resultant length may be used to perform hypothesis testing of probability distributions for a correspondingly determined unbiased mean phase.

According to another advantageous embodiment corresponding values, in time and frequency, of the unbiased mean phase and the resultant length can be used to identify and distinguish between at least two target sources, based on identification of direct sound comprising at least two different values of the unbiased mean phase.

According to yet another advantageous embodiment corresponding values, in time and frequency, of the unbiased mean phase and the resultant length can be used to estimate whether a distance to a target source is increasing or decreasing based on whether the value of the resultant length is decreasing or increasing respectively. This can be done because the reflections, at least while being indoors in say some sort of room will tend to dominate the direct sound, when the target source moves away from the hearing aid system user. This can be very advantageous in the context of beam former control because speech intelligibility can be improved by allowing at least the early reflections to pass through the beam former.

Figure 4:
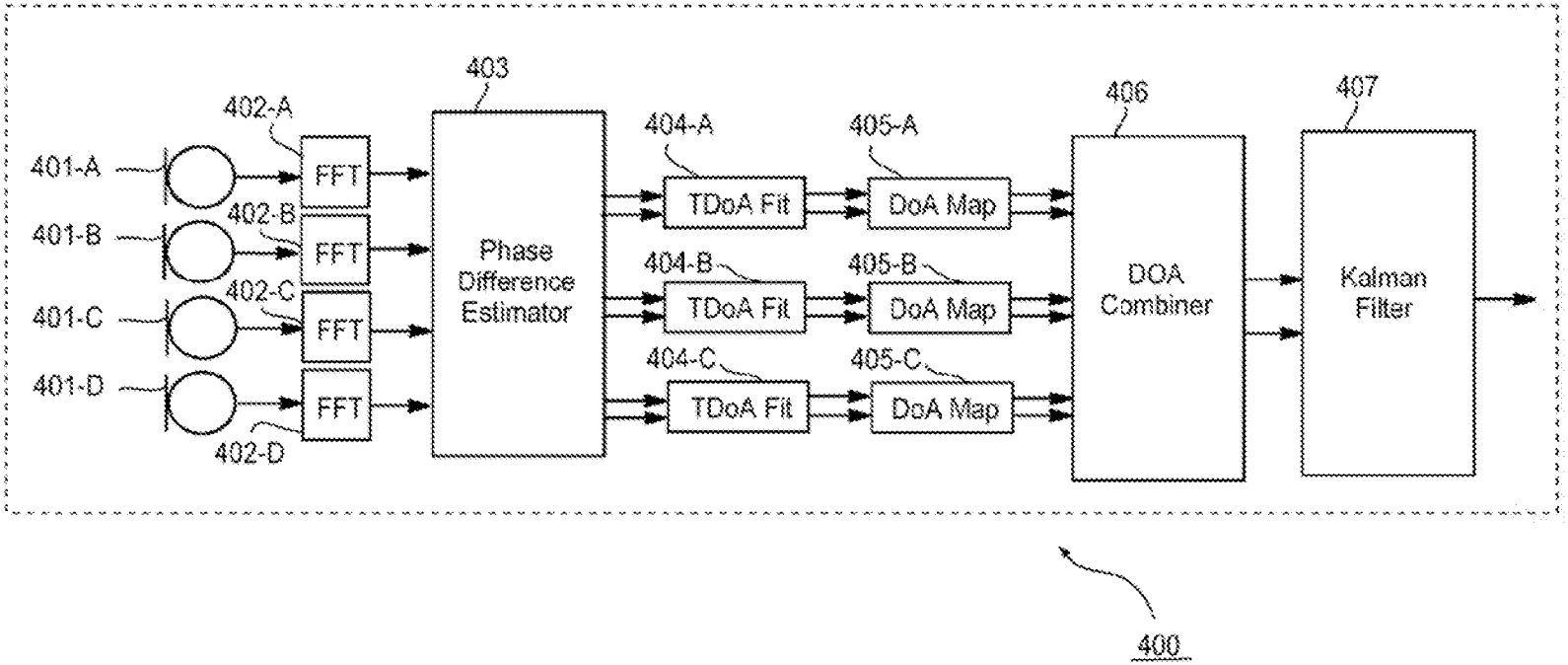
FIG. 4 illustrates highly schematically a binaural hearing aid system according to an embodiment of the invention.

Reference is now given to FIG. 4, which illustrates highly schematically a binaural hearing aid system 400 according to an embodiment of the invention. For reasons of clarity the digital signal processor and the electrical-acoustical output transducer The binaural hearing aid system comprises four microphones (401-A, 401-B, 401-C and 401-D). Two microphones are accommodated in each of the hearing aids comprised in the binaural hearing aid system.

In variations the hearing aid system may comprise additional microphones accommodated in external devices such as smart phones or dedicated remote microphone devices.

The input signals from the four microphones (401-A, 401-B, 401-C and 401-D) are first transformed into the time-frequency domain using a short-time Fourier transformation as illustrated by the Fourier processing blocks (402-A, 402-B, 402-C and 402-D).

In variations other time-frequency domain transformations may be applied such as polyphase filterbanks, and weighted overlap-add (WOLA) transformations as will be obvious for a person skilled in the art.

In a next step the transformed input signals are provided to the phase difference estimator (403) in order to obtain estimates of the inter-microphone phase difference (IPD) between sets of input signals. Thus according to the present embodiment three IPDs are estimated based on respectively the set of input signals from two microphones in the first hearing aid, the set of input signals from two microphones in the second hearing aid, whereby two monaural IPDs are estimated and based on input signals from a microphone from each of the hearing aids whereby a binaural IPD is provided.

The instantaneous IPD at frame 1 and frequency bin k, which in the following is denoted by $e^{j\Theta_{ab}(k,l)}$ and which in the following may be denoted simply IPD, thus leaving out the term instantaneous for reasons of clarity, and which is defined based on two microphones a and b and may be given by the instantaneous normalized cross-spectrum:

$$e^{j\theta_{ab}(k,l)} = \frac{X_a(k,l)X_b^*(k,l)}{|X_a(k,l)|\ |X_b(k,l)|}; \quad \text{(eq. 16)}$$

where $X_a(k,l)$ and $X_b(k,l)$ are the short-time Fourier transforms of the considered set of input signals at the two microphones. We assume that $\theta_{ab}$ (k,l) is a specific realization of a circular random variable $\Theta$ and therefore that the statistical properties of the IPDs are governed by circular statistics and therefore that the mean of the IPD may be given by:

$$E\{e^{j\Theta_{ab}(k,l)}\} = R_{ab}(k,l)e^{j\hat{\theta}_{ab}(k,l)}; \quad \text{(eq. 17)}$$

where E is a short-time expectation operator (moving average), $\hat{\theta}_{ab}$ is the unbiased mean phase and $R_{ab}$ is the mean resultant length (it is noted that eq. 9 is very similar to eq. 17, the primary difference being the notation and the specification that the Instantaneous IPD is given as a function of the Fourier transformation frame 1 and the frequency bin k. The mean resultant length carries information about the directional statistics of the impinging signals at the hearing aid, specifically about the spread of the IPD. For uniformly distributed $\Theta$, which corresponds to the signal at the two microphones being completely uncorrelated, the associated mean resultant length $R_{ab}$ goes to 0 and at the other extreme $\Theta$ is distributed as a Dirac delta function ($\Theta \sim W\{\delta(\theta_{ab}-\theta_0)\}$ corresponding to an ideal anechoic source for a specific frequency f at $\theta_0 = 2\pi fd/c \cos\varphi$, where W{ } denotes the transformation mapping a probability density function to its wrapped counterpart, d is the inter-microphone spacing, c is the speed of sound and $\phi$ is the angle of arrival relative to the rotation axis of the microphone pair. In this case, the mean resultant length $R_{ab}$ converges to one. A particular detrimental type of interference, both for speech intelligibility and for common Time Difference of Arrival (TDoA) and Direction of Arrival (DoA) algorithms, is late reverberation typically modeled as diffuse noise. Diffuse noise is characterized by being a sound field with completely random incident sound waves. This corresponds to the IPD having a uniform probability density ($\Theta \sim w\{U(-\pi f/f_u;\pi f/f_u)\}$ where $f_u = c/2d$ is the upper frequency limit below which phase ambiguities, due to the $2\pi$ periodicity of the IPD, are avoided. For diffuse noise scenarios, the mean resultant length $R_{ab}$ for low frequencies ($f \ll f_u$) approaches one. It gets close to zero as the frequency approaches the phase ambiguity limit. Thus, at low frequencies, both diffuse noise and localized sources have similar mean resultant length $R_{ab}$ and it becomes difficult to statistically distinguish the two sound fields from each other. To resolve the afore mentioned limitation, we propose transforming the IPD such that the probability density for diffuse noise is mapped to a uniform distribution ($\Theta \sim U(-\pi;\pi)$ for all frequencies up to $f_u$ while preserving the mean resultant length $R_{ab}$ of localized sources. Under free- and far-field conditions and assuming that the inter-microphone spacing d is known, the mapped mean resultant length $\tilde{R}_{ab}(k,l)$, which is the mean resultant length of the transformed IPD, takes the form:

$$\tilde{R}_{ab}(k,l)=|E\{e^{j\theta_{ab}(k,l)k_u/k}\}|, \quad \text{(eq. 18)}$$

wherein $k_u=2K\ f_u/f_s$, with $f_s$ being the sampling frequency, K the number of frequency bins up to the Nyquist limit. The mapped mean resultant length $\tilde{R}_{ab}$ for diffuse noise approaches zero for all $k<k_u$ while for anechoic sources it approaches one as intended.

Commonly used methods for estimating diffuse noise are only applicable for $k>k_u$. Unlike those methods, the mapped mean resultant length $\tilde{R}_{ab}$ works best for $k<k_u$ and is particularly suitable for arrays with very short microphone spacing such as hearing aids. Particularly, for Time Difference of Arrival (TDoA) estimation, using the mapped mean resultant length $\tilde{R}_{ab}$ instead of the mean resultant length $R_{ab}$, applies the correct weight on time-frequency frames with diffuse noise for low frequency TDoA estimation for small microphone arrays.

In variations only frequencies up to $k_u$ are considered when applying the mapped mean resultant length $\tilde{R}_{ab}$ for the various estimations of the present invention. At higher frequencies, both for the small spacing between the two microphones on one hearing aid (i.e., monaural case) and across the ears (i.e., binaural case), the assumptions of free- and far-field break down, which makes the implementation of a system for determining DOA considerably more complex.

However, in the next step the unbiased mean phases $\hat{\theta}_{ab}$ and the mapped mean resultant lengths $\tilde{R}_{ab}$ calculated for each of the three considered microphone pairs is provided to the TDoA fitting blocks (404-A, 404-B and 404-C). According to the present embodiment the TDoA fitting is implemented using three blocks coupled in parallel but obviously the functionality may alternatively be implemented using a single TDoA fitting block operating serially.

Given the unbiased mean phases $\hat{\theta}_{ab}$ and the mapped mean resultant lengths $\tilde{R}_{ab}$ calculated so far, the TDoA corresponding to the direct path from a given source needs to be estimated. In free- and far-field conditions the TDoA of a single stationary broadband source corresponds to a constant group delay across frequency, which reduces the problem of estimating the TDoA to fitting a straight line $\theta(f)=2\pi f\tau$, wherein $\tau$ represents the TDoA. Because the IPDs are circular variables, the estimation of TDoA requires solving a circular-linear fit. However, since we are only considering frequencies below $f_u$, hereby avoiding phase ambiguity, an ordinary linear fit can be used as an approximation.

In variations non-linear fits can be considered e.g. where far- and free-field assumptions are not applicable.

In a commonly used least mean square fit, it is assumed that all data is pulled from a common distribution. However, according to the present invention, for each unbiased mean phase $\hat{\theta}_{ab}$, a mapped mean resultant length $\tilde{R}_{ab}$ is estimated, which corresponds to a reliability measure for the unbiased mean phase $\hat{\theta}_{ab}$. Due to the small inter-microphone spacings in a hearing aid system, it is, as discussed above, advantageous to employ the mapped mean resultant length $\tilde{R}_{ab}$ instead of the mean resultant length $R_{ab}$.

Now, assuming for simplicity that the IPD follows a wrapped normal distribution, the variance $\sigma_{ab}^2$ is given by:

$$\sigma_{ab}^2(k,l)=-2\log(\tilde{R}_{ab}(k,l)), \quad \text{(eq. 19)}$$

For small variances a wrapped normal distribution is well approximated by a normal distribution. However, for small sample sizes, the low mapped mean resultant length $\tilde{R}_{ab}$ values are overestimated, corresponding to an underestimation of the variance, which leads to over emphasizing uncertain data points (i.e. the unbiased mean phases) in the fit. As one way to circumvent this problem, we empirically found that using circular dispersion defined as $$\delta_{ab}(k,l)=\frac{1-\tilde{R}_{ab}(k,l)^4}{2\tilde{R}_{ab}(k,l)^2} \quad \text{(eq. 20)}$$

for a wrapped normal distribution, deemphasizes the uncertain data points. The reason for this is that the circular dispersion $\delta_{ab}$ penalizes low mapped mean resultant length $\tilde{R}_{ab}$ values more than the variance $\sigma_{ab}^2$ values, while providing practically the same results for higher mapped mean resultant length $\tilde{R}_{ab}$ values. Considering that each data point (i.e. the unbiased mean phase) has a known variance given by the circular dispersion and approximating the wrapped normal distribution with the normal distribution, the best least mean square fitted TDoA $\tau_{ab}$ takes the form:

$$\tau_{ab}(l)=\frac{1}{2\pi}\frac{\sum_{k=1}^{K'}\frac{\hat{\theta}_{ab}(k,l)f(k)}{\delta_{ab}(k,l)}}{\sum_{k=1}^{K'}\frac{f(k)^2}{\delta_{ab}(k,l)}} \quad \text{(eq. 21)}$$

wherein k is the frequency bin index, $\hat{\theta}_{ab}$ is the unbiased mean phase, K' is the number of frequency bins over which the fit is done, and f(k) is the actual frequency that is given by $f(k)=f_s k/(2K)$ with $f_s$ being the sampling frequency and K the number of frequency bins up to the Nyquist limit.

Furthermore the variance of the estimated TDoA, using (eq. 21) can by approximating $\delta_{ab}$ as a deterministic variable, be written as:

$$\mathrm{var}(\tau_{ab}(l))=\frac{1}{4\pi^2}\frac{1}{\sum_{k=1}^{K'}\frac{f(k)^2}{\delta_{ab}(k,l)}} \quad \text{(eq. 22)}$$

This expression provides a computationally simple closed form approximation of the variance of the estimated TDoA, which can advantageously be utilized throughout the further stages to associate data based on their variance.

In variations the TDoA is estimated using, not only a single data fitting, of a plurality of unbiased mean phases weighted by a corresponding plurality of reliability measures but by carrying out a plurality of data fittings, based on a plurality of data fitting models.

According to one specific example the plurality of data fitting models differ at least in the number of sound sources that the data fitting models are adapted to fit. Hereby comparison of the results provided by the data fitting models can improve the ability to determine e.g. the number of speakers in the sound environment.

According to another specific variation the plurality of data fitting models differ in the frequency range the data fitting models are adapted to fit. This variation may provide improved results by e.g. combining the results of a linear fit in one frequency range with a non-linear fit in another frequency range, which is particularly advantageous in case the unbiased mean phases are only linear over a part of the considered frequency range, which may be the case for some transformed estimated inter-microphone phase differences.

According to yet other variations the data fitting models are based on machine learning methods selected from a group at least comprising deep neural networks, Bayesian models and Gaussian Mixture Models.

In still other variations the data fitting model comprises determining the unbiased mean phases from a transformed estimated inter-microphone phase difference $IPD_{Tranform}$ given by the expression: $IPD_{Tranform}=e^{j\theta_{ab}(k,l)k_u/k}$, wherein $k_u=2K\ f_u/f_s$, with $f_s$ being the sampling frequency and K being the number of frequency bins up to the Nyquist limit and determining the time difference of arrival as the parallel offset of a fitted curve for the transformed unbiased mean phases as function of frequencies below a threshold frequency $f_u=c/2d$, below which phase ambiguities, due to the $2\pi$ periodicity of the inter-microphone phase difference, are avoided and wherein d is the inter-microphone spacing and c is the speed of sound.

In a variation the reliability measure associated with an unbiased mean phase may be dependent on the sound environment such that e.g. the reliability measure is based on the mean resultant length as given in eq. 17 if the sound environment is dominantly uncorrelated noise and is based on the unwrapped mean resultant length, i.e. as given in eq. 18, if diffuse noise dominates the sound environment.

In the next step the estimated TDoA and its variance is provided, for each of the three considered microphone pairs, to the DoA map blocks (405-A, 405-B and 405-C). According to the present embodiment the DoA functionality is implemented using three blocks coupled in parallel but obviously the functionality may alternatively be implemented using a single DoA map block operating serially.

In the following only azimuth DoA is considered and the look direction of the hearing aid system user is defined as zero. Three microphone sets (which may also be denoted pairs) are considered in the present embodiment: the two (left and right) monaural combinations ($M\in\{L, R\}$) and a binaural (B) pair. In variations additional binaural pairs can be included to improve the accuracy. Assuming far and free field and that the monaural arrays point in the look direction, the local monaural DoAs $\phi_M$ can be estimated from the monoural TDoAs as follows:

$$\phi_M = \cos^{-1}\left(\frac{c}{d_M}\tau_M\right) \quad \text{(eq. 23)}$$

wherein $d_M$ is the inter-microphone spacing between the two microphones on one hearing aid (monoural). Note that, even though the calculations take place at each frame 1 (i.e., $\phi_M\equiv\phi_M(l)$) then the time index (i.e. the frame index 1) is omitted for reasons of clarity. Now, using the Taylor expansion of Eq. (23) around $\phi_M=90°$, the variance of the estimated local monaural DoAs can be approximated from the variance of the TDoAs as:

$$\mathrm{var}(\phi_M) \approx \left(\frac{c}{d_M}\right)^2 \mathrm{var}(\tau_M) \quad \text{(eq. 24)}$$

wherein the variance of the TDoA is given in (eq. 22). For the binaural microphone pair, we assume far field and an ellipsoidal head model, e.g. as given in the paper by Duda et al. "An adaptable ellipsoidal head model for the interaural time difference," in ICASSP, 1999, pp. 965-968. From this, the local binaural DoA $\phi_B$ is well approximated by:

$$\phi_B \approx \frac{c}{d_B}\tau_B \quad \text{(eq. 25)}$$

wherein $d_B$ is the inter-microphone spacing between the two hearing aids on the head and the look direction is perpendicular to the rotation axis of the binaural microphone pair. The variance of the estimated local binaural DoA can be written as $$\mathrm{var}(\phi_B) = \left(\frac{c}{d_B}\right)^2 \mathrm{var}(\tau_B) \quad \text{(eq. 26)}$$

The estimated local DoAs are circular variables and their estimated variances are transformed to mean resultant lengths using eq. (19), where each local DoA is assumed to follow a wrapped normal distribution. We denote $R_M(M\in\{L, R\})$ and $R_B$ as the monaural and the binaural mean resultant lengths associated with the direction of arrivals, respectively. These resultant lengths may also each be denoted local reliability measure.

In the next step the mean resultant lengths associated with the estimated local DOA's are provided to the DOA combiner 406 in order to provide a common DOA that may also be denoted a common mean direction $\hat{\varphi}$ and a corresponding common mean resultant length R that may also be denoted a common reliability measure.

The monaural DoA estimates for the left and the right pairs are defined in the interval $[0, \pi]$ due to the rotational symmetry around the line connecting the microphones. Correspondingly, the binaural DoA is defined within $$\left[-\frac{\pi}{2}, \frac{\pi}{2}\right].$$

In order to combine the information from the monaural pairs and the binaural pair, a common support must be established. This is accomplished by mapping all azimuth estimates onto the full circle ($\varphi\in[-\pi, \pi]$). Using the binaural pair, it is determined whether a given source is to the left ($\phi_B\geq 0$) or to the right ($\phi_B\leq 0$). Based on this, if the source is located on the left, the left monaural microphone pair is chosen ($\varphi_M=\phi_L$), and similarly on the right side ($\varphi_M=-\phi_R$). Due to the head shadow effect, the monaural microphone pair closer to the source yields a more reliable estimate. From the chosen monaural pair it can be determined if a potential source is in front of ($|\varphi_M|\leq\pi/2$) or behind ($|\varphi_M|>\pi/$ 2) the hearing aid user. When a source is in the front, then $\varphi_B=\phi_B$. If the source is determined to be to the right and behind the wearer, then $\varphi_B=-\pi-\phi_B$, and if it is behind and to the left, then $\varphi_B=\pi-\phi_B$. The mean resultant lengths are invariant under translations and are converted directly. Note that the choice of the monaural mean resultant length depends on which hearing aid is closer to the source.

An alternative implementation of the above may be extended to also estimate the elevation in addition to the azimuth.

We have a monaural and a binaural azimuth estimate of the full-circle DoA with their corresponding mean resultant lengths. From this, a statistical test is performed to assess the null hypothesis that the two estimates have a common mean. The modified test statistic that we employ is:

$$Y = 2\left(\left(\frac{w_M}{\delta_M} + \frac{w_B}{\delta_B}\right) - \sqrt{C^2 + S^2}\right) \quad \text{(eq. 27)}$$

where C and S are given by:

$$C = \frac{w_M}{\delta_M}\cos(\varphi_M) + \frac{w_B}{\delta_B}\cos(\varphi_B) \quad \text{(eq. 28)}$$
$$S = \frac{w_M}{\delta_M}\sin(\varphi_M) + \frac{w_B}{\delta_B}\sin(\varphi_B)$$

Here, $\delta$ is the circular dispersion defined in eq. 20, and $w_M=\mathrm{Sin}^2(\varphi_M)$ and $w_B=\mathrm{Cos}^2(\varphi_B)$ are weighting factors for the monaural and binaural estimates, respectively, and Y is the test statistic to be compared with the upper 100 $(1-\alpha)$% point of the $X_1^2$ distribution, with a as the significance level. The weighting factors are used to effectively reduce the reliability of the estimates to compensate for the approximations made in eq. 24 and eq. 26. If the null hypothesis is accepted with $\alpha=0:1$, a common mean direction $\hat{\varphi}$ of the two estimates may be calculated as:

$$\hat{\varphi}=\angle\{w_1R_Me^{i\varphi_M}+w_2R_Be^{i\varphi_B}\} \quad \text{(eq. 29)}$$

with $$w_1 = \frac{w_M/(R_M\delta_M)}{w_M/(R_M\delta_M)+w_B/(R_B\delta_B)} \quad \text{(eq. 30)}$$
$$w_2 = \frac{w_B/(R_B\delta_B)}{w_M/(R_M\delta_M)+w_B/(R_B\delta_B)}$$

Similarly, the circular dispersion of the common mean direction is:

$$\delta = 2\frac{w_1^2R_M^2\delta_M + w_2^2R_B^2\delta_B}{(w_1R_M + w_2R_B)^2} \quad \text{(eq. 31)}$$

Subsequently, the mean resultant length of the common mean R can be calculated by solving eq. 20 for R using the circular dispersion $\delta$ of the common mean given by eq. 30 and hereby obtaining:

$$R = 2\frac{1}{\sqrt{\delta + \sqrt{1+\delta^2}}} \quad \text{(eq. 32)}$$

If the null hypothesis is rejected, the DoA and its mean resultant length are chosen from the estimate with the lowest circular dispersion, i.e., either the monaural or the binaural. From the above development, the information provided from the monaural and the binaural local DoAs and their variance are combined to make a unified full-circle DoA estimate $\hat{\varphi}$ in Eq. 29 with an accompanying circular dispersion $\delta$ given in eq. 31 and the mean resultant length R given in eq. 32.

In variations other statistical hypothesis tests may be used as will be obvious for a person skilled in the art. However, in still other variations Bayesian or Gaussian Mixture Models may be applied, but it is noted that the statistical hypothesis test is processing effective and as such very well suited for hearing aid applications.

In the final step, the unified full-circle DoA estimate $\hat{\varphi}$ and the corresponding circular dispersion $\delta$ given in eq. 31 or the mean resultant length R given in eq. 32 (wherein both the latter may in the following be denoted a common reliability measure) are provided to a Kalman filter 407 in order to provide an over time smoothed estimate of the DOA.

The azimuth estimation (i.e. the common DOA) provided from the DOA combiner 406 is very noisy, but at the same time it is accompanied by an instantaneous measure of reliability in the form of the mean resultant length R (given by eq. 32) or the circular dispersion (given by eq. 31). Using an angle-only wrapped Kalman filter, such as the filter described in the paper "A wrapped Kalman filter for azimuthal speaker tracking," by Traa and Smaragdis, IEEE Signal Processing Letters, vol. 20, no. 12, pp. 1257-1260, 2013, a smoother estimate is obtained.

However, the present invention differs from the prior art such as the paper referred to above in that the so called innovation term is updated at each frame using the circular dispersion as an approximation, as opposed to using a fixed and known variance denoted by $\sigma_w^2$. By using the circular dispersion provided in eq. 32 instead of the variance, low R values map onto higher $\sigma_w^2$ values.

In variations the reliability measure may be extended to use additional information such as signal energy and speech presence probability.

In variations the smoothing filter 407 is adapted to operate based on at least one of Bayesian filtering and machine learning methods utilizing a statistical model of the provided data and prior estimates, wherein the selected Kalman filter can be considered a specific example.

The use of prior estimates (including the prior reliability measures) in the above mentioned methods are particularly advantageous in applications comprising at least one of localization and tracking of especially multiple and possibly moving sound sources.

In variations the TDoAs and the corresponding reliability measures are provided directly to machine learning methods, such as deep neural networks and Bayesian methods in order to provide the DOA.

In further variations the unbiased mean phases and the corresponding reliability measures are provided directly to machine learning methods, such as deep neural networks and Bayesian methods in order to provide the DOA.

It is noted that these machine learning methods benefit drastically by the estimated reliability measures provided by the present invention.

The methods and its variations (i.e. generally both the methods directed at determining TDoA and the methods directed at determining DOA respecitively) disclosed with reference to FIG. 4 may generally be used in further stages of hearing aid system processing.

In more specific variations the further stages of hearing aid system processing includes spatially informed speech extraction and noise reduction, enhanced beamforming through provided steering vectors and corresponding suitable constraints, spatialization (e.g. by applying a Head Related Transfer Function (HRTF) of streamed audio from an external microphone device based on a determined DOA), auditory scene analyses and classification based on the possible detection of one or more specific sound sources, improved source separation, audio zoom, improved spatial signal compression (e.g. in order to improve spatial cues for sounds from certain directions or in certain situations), improved speech detection (e.g. based on allowing spatial preferences), detecting acoustical feedback (e.g. by using that the onset of an acoustical feedback signal will exhibit characteristic values of DOA and reliability measures that are relatively easy to distinguish from other types of highly coherent signals such as music), user behavior (e.g. finding the preferred sound source direction for the individual user) and own voice detection (e.g. by utilizing the location and vicinity of the hearing aid system users mouth).

Considering own voice detection it is worth noting that fitting the plurality of weighted unbiased mean phases across frequency, wherein the unbiased mean phases are determined from a transformed estimated inter-microphone phase difference $IPD_{Tranform}$ given by the expression:

$$IPD_{Tranform} = e^{\frac{j\theta_{ab}(k,l)k_u}{k}} \quad \text{(eq. 33)}$$

wherein $k_u=2K\ f_u/f_s$, with $f_s$ being the sampling frequency and K being the number of frequency bins up to the Nyquist limit. Assuming free and far field this transformation maps a TDoA to not represent the slope of the mean inter-microphone phase difference but rather a parallel offset of the mean of a transformed estimated inter-microphone phase difference across frequency, which can be estimated by fitting accordingly, again using a reliability measure as weighting in the fit. This approach offers a particularly efficient TDoA estimation method for particularly signals impinging perpendicularly to line connecting the two microphones on the microphone set. A particular usage of this is for binaural own voice detection where the own voice generally has a binaural TDOA of zero.

In variations the mapped mean resultant length may be given by other expressions than the one given in eq. 18, e.g.:

$$\tilde{R}_{ab}(k,l)=|E\{f(e^{j\Theta_{ab}(k,l)p(k,l)})\}| \quad \text{(eq. 34)}$$

wherein indices l and k represent respectively the frame used to transform the input signals into the time-frequency domain and the frequency bin; wherein E is an expectation operator; wherein $e^{j\Theta_{ab}(k,l)}$ represents the inter-microphone phase difference between the first and the second microphone; wherein p is a real variable; and wherein f is an arbitrary function.

In more specific variations p is an integer in the range between 1 and 6 and the function f is given as f(x)=x, whereby the mapped mean resultant lengths according to these specific variations represent the circular statistics moments, which may give insight into the underlying probability distributions.

It is noted that the variations of the mapped mean resultant length given by eq. 34 also provides at least a similar amount of additional reliability measures.

According to an especially advantageous embodiment the high signal-to-noise ratio of an input signal received by at least one microphone of an external device (due to the assumed close proximity between a target source (i.e. a person speaking) and the external device) may be used to allow the hearing aid system to identify and estimate the DOA from the target source by forming a plurality of microphone sets, wherein a microphone from the external device is used. Hereby sound streamed from the external device and to the hearing aid system may be enriched with appropriate binaural cues based on the estimated DOA.

The present method and its variations are particularly attractive for use in hearing aid systems, because these systems due to size requirements only offer limited processing resources, and the present invention provides a very precise DOA estimate while only requiring relatively few processing resources.

In further variations the methods and selected parts of the hearing aid according to the disclosed embodiments may also be implemented in systems and devices that are not hearing aid systems (i.e. they do not comprise means for compensating a hearing loss), but nevertheless comprise both acoustical-electrical input transducers and electro-acoustical output transducers. Such systems and devices are at present often referred to as hearables. However, a headset is another example of such a system.

According to yet other variations, the hearing aid system needs not comprise a traditional loudspeaker as output transducer. Examples of hearing aid systems that do not comprise a traditional loudspeaker are cochlear implants, implantable middle ear hearing devices (IMEHD), bone-anchored hearing aids (BAHA) and various other electro-mechanical transducer based solutions including e.g. systems based on using a laser diode for directly inducing vibration of the eardrum.

In still other variations a non-transitory computer readable medium carrying instructions which, when executed by a computer, cause the methods of the disclosed embodiments to be performed.

Generally, the various embodiments and their variations may be combined unless it is explicitly stated that they cannot be combined.

Other modifications and variations of the structures and procedures will be evident to those skilled in the art.

The invention claimed is:

1. A method of operating a hearing aid system comprising the steps of:

providing a plurality of input signal sets, each consisting of two input signals, wherein the input signals represent the output from a microphone;

transforming the input signals from a time domain representation and into a time-frequency domain representation;

estimating an inter-microphone phase difference between the input signals for each of said plurality of input signal sets using the time-frequency domain representation of the input signals;

determining an unbiased mean phase and a mapped mean resultant length, from each of said estimated inter-microphone phase differences;

estimating a time difference of arrival, for each of said input signal sets, using a plurality of unbiased mean phases weighted by a corresponding plurality of reliability measures, wherein each of the reliability measures are derived at least partly from a corresponding mapped mean resultant length;

deriving an estimate of a local direction of arrival and a corresponding local reliability measure for each of the estimated time difference of arrivals, wherein the local reliability measures are at least partly derived from the corresponding mapped mean resultant lengths;

providing an estimate of a common direction of arrival by combining the estimated local directions of arrival and the corresponding local reliability measures;

using the estimate of the common direction of arrival as input to at least one hearing aid system processing stage.

2. The method according to claim 1 comprising the further step of:

providing a common reliability measure corresponding to the estimated common direction of arrival by combining the estimated local directions of arrival and the corresponding local reliability measures.

3. The method according to claim 2 comprising the further step of:

using the common reliability measure as input to the at least one hearing aid system processing stage.

4. The method according to claim 2, wherein the step of providing an estimate of a common direction of arrival comprises the further steps of:

providing a plurality of estimates of the common direction of arrival and corresponding common reliability measures as input to a smoothing filter adapted to operate based on at least one of Kalman filtering, Bayesian filtering and machine learning methods utilizing a statistical model of the provided data and prior estimates.

5. The method according to claim 1, wherein the at least one hearing aid system processing stage is selected from a group of hearing aid system processing stages comprising: spatially informed speech extraction and noise reduction, enhanced beamforming through provided steering vectors and corresponding suitable constraints, spatialization of streamed audio from an external microphone device, auditory scene analyses and classification based on the possible detection of one or more specific sound sources, improved source separation, audio zoom, improved spatial signal compression, improved speech detection, acoustical feedback detection, user behavior estimation and own voice detection.

6. The method according to claim 1, wherein the step of providing the estimate of the common direction of arrival by combining the estimated local directions of arrival and the corresponding local reliability measures comprises the further steps of:

mapping all the estimated local directions of arrival onto a full circle and hereby providing a monaural and a binaural direction of arrival estimate;

using a statistical test in order to assess whether the monaural and binaural direction of arrival estimates have a common mean;

combining the monaural and binaural direction of arrival estimates and hereby providing the estimate of the common direction of arrival if a statistical test assesses that the monaural and binaural direction of arrival estimates have a common mean.

7. The method according to claim 1, wherein the step of providing the estimate of the common direction of arrival by combining the estimated local directions of arrival and the corresponding local reliability measures comprises the further steps of:

mapping all the estimated local directions of arrival onto a full circle and hereby providing a monaural and a binaural direction of arrival estimate;

using a statistical test in order to assess whether the monaural and binaural direction of arrival estimates have a common mean and if this is not the case carrying out the further steps of;

determining whether the monaural or binaural direction of arrival estimate is most reliable based on the corresponding monaural and binaural reliability measures;

selecting as the estimate of the common direction of arrival the direction of arrival estimate that is most reliable.

8. The method according to claim 2, wherein the steps of providing the estimate of the common direction of arrival and the estimate of the corresponding common reliability measure by combining the estimated local directions of arrival and the corresponding local reliability measures comprises the further steps of:

mapping all the estimated local directions of arrival onto a full circle;

using statistical methods selected from a group of methods comprising statistical tests, Bayesian methods and machine learning methods in order to combine the local direction of arrival estimates to provide the estimate of the common direction of arrival and the estimate of the corresponding common reliability measure.

9. The method according to claim 1, wherein the mapped mean resultant length $\tilde{R}_{ab}$ (k, l) is determined, at least partly, using an expression from a group of expressions comprising:

expressions of the form given by:

$$\tilde{R}_{ab}(k,l)=|E\{f(e^{j\Theta_{ab}(k,l)p(k,l)})\}|$$

wherein indices l and k represent respectively the frame used to transform the input signals into the time-frequency domain and the frequency bin;

wherein E is an expectation operator;

wherein $e^{j\Theta_{ab}(k,l)}$ represents the inter-microphone phase difference between the first and the second microphone;

wherein p is a real variable; and wherein f is an arbitrary function.

10. A hearing aid system comprising a first and a second hearing aid and a binaural wireless link between the two hearing aids, wherein each of the hearing aids comprises a set of microphones, a filter bank, a digital signal processor and an electrical-acoustical output transducer;

wherein the binaural wireless link is adapted to provide, for each of the hearing aids, transmission of at least one ipse-lateral input signal, from an ipse-lateral microphone, to the contra-lateral hearing aid whereby at least one binaural microphone set is provided;

wherein the filter bank is adapted to:

transform the input signals from the provided microphone sets from a time domain representation and into a time-frequency domain representation;

wherein the digital signal processor is configured to apply a frequency dependent gain that is adapted to at least one of suppressing noise and alleviating a hearing deficit of an individual wearing the hearing aid system;

wherein the digital signal processor is adapted to:

estimating inter-microphone phase differences between the input signals for each of the provided microphone sets using the time-frequency domain representation of the input signals;

determining an unbiased mean phase and a mapped mean resultant length, from each of said estimated inter-microphone phase differences;

estimating a time difference of arrival, for each of said input signal sets, using a plurality of unbiased mean phases weighted by a corresponding plurality of reliability measures, wherein each of the reliability measures are derived at least partly from a corresponding mapped mean resultant length;

deriving an estimate of a local direction of arrival and a corresponding local reliability measure for each of the estimated time difference of arrivals, wherein the local reliability measures are at least partly derived from the corresponding mapped mean resultant lengths;

providing an estimate of a common direction of arrival by combining the estimated local directions of arrival and the corresponding local reliability measures; and using the estimate of the common direction of arrival as input to at least one hearing aid system processing stage.

11. The hearing aid system according to claim 10, wherein the digital signal processor is adapted to carry out at least one hearing aid system processing stage selected from a group comprising:

spatially informed speech extraction and noise reduction, enhanced beamforming through provided steering vectors and corresponding suitable constraints, spatialization of streamed audio from an external microphone device, auditory scene analyses and classification based on the possible detection of one or more specific sound sources, improved source separation, audio zoom, improved spatial signal compression, improved speech detection, acoustical feedback detection, user behavior estimation and own voice detection.

12. The hearing aid system according to claim 10 comprising:

additional microphones accommodated in at least one external device from a group of external devices comprising smart phones and dedicated remote microphone devices; and at least one external wireless link between the two hearing aids and the at least one external device.

13. A non-transitory computer readable medium carrying instructions which, when executed by a computer, cause any one of the methods according to claim 1 to be performed.

* * * * *